United States Patent [19]

Bagnall

[11] 4,399,758

[45] Aug. 23, 1983

[54] MECHANISM FOR IMPROVING TUFTING MACHINE NEEDLE BAR SHIFTING

[75] Inventor: Arthur F. Bagnall, Whitefield, England

[73] Assignee: Spencer Wright Industries, Inc., Chattanooga, Tenn.

[21] Appl. No.: 245,376

[22] Filed: Mar. 19, 1981

[30] Foreign Application Priority Data

Mar. 21, 1980 [GB] United Kingdom ..... 8009665

[51] Int. Cl.[3] ..... D05C 15/00

[52] U.S. Cl. ..... 112/79 R

[58] Field of Search ..... 112/79 A, 79 FF, 221; 66/207

[56] References Cited

U.S. PATENT DOCUMENTS

| | | | |
|---|---|---|---|
| 3,089,322 | 3/1963 | Bruce et al. | 66/207 |
| 3,109,395 | 11/1963 | Batty et al. | 112/79 R |
| 3,213,813 | 10/1965 | Chambers | 112/79 R |
| 3,447,344 | 6/1969 | Zwingenberger et al. | 66/207 |
| 3,934,524 | 1/1976 | Smith | 112/79 A |
| 3,952,549 | 4/1976 | Kohl | 60/207 |
| 3,964,407 | 6/1976 | Ingram et al. | 112/79 R |
| 3,964,408 | 6/1976 | Smith | 112/79 A |
| 4,139,997 | 2/1979 | Riesen | 66/207 |
| 4,173,192 | 11/1979 | Schmidt et al. | 112/79 A X |
| 4,285,287 | 8/1981 | Inman | 112/79 R |

*Primary Examiner*—Ronald Feldbaum

*Attorney, Agent, or Firm*—Alan Ruderman

[57] ABSTRACT

A tufting machine has a transversely shiftable needle bar driven by a pattern cam, the needle bar is further acted upon by biasing mechanism arranged to urge it in a direction opposite to the direction it is being driven by the cam so as to take up the lost motion due to clearances in the cam drive system. The specific biasing mechanism disclosed is an air thruster acting on a pivotably mounted bracket having a roller acting on the needle bar in opposition to the load applied by the cam. The load is applied by a pivotably mounted arm connected to the cam drive. The arm is also connected by a rod to the bracket as an assurance.

6 Claims, 2 Drawing Figures

MECHANISM FOR IMPROVING TUFTING MACHINE NEEDLE BAR SHIFTING

BACKGROUND OF THE INVENTION

This invention relates to tufting machines and is more particularly concerned with a mechanism for effecting longitudinal displacement of a needle bar of a tufting machine to adjust the position thereof for purposes of pattern control.

A known mechanism for effecting longitudinal positional adjustment of a needle bar of a tufting machine comprises a cam/cam follower arrangement which is connected to the bar so as to act, during use of the machine, to subject the bar to a sequence of movement in both longitudinal directions thereof, such sequence being dictated by the shape of the surface of the cam which the cam follower is constrained to follow. With this known construction however a high degree of operating precision cannot be ensured due to lost motion arising from clearances in the mechanism whereby it is difficult to achieve accurate following of the cam surface and thus satisfactory pattern control especially in the case of high speed fine gauge tufting machines.

SUMMARY OF THE INVENTION

An object of the present invention is to overcome or at least appreciably reduce this problem.

According to the invention therefore there is provided a mechanism for effecting displacement of a needle bar of a tufting machine, transverse to the direction of fabric feed, comprising drive means arranged to act on said bar to effect said displacement thereof in at least one transverse direction, and biasing means arranged to act on said bar so as to urge same in a direction opposite to said one direction.

With this arrangement, precise rapid movement of the bar can be achieved, even with high speed fine gauge tufting machines, in so far as the biasing means can act to take up clearances in the mechanism and thereby eliminate or appreciably reduce lost motion.

The said drive means may comprise a cam/cam follower arrangement of any suitable kind including the arrangement described in our co-pending application of even date.

The said biasing means preferably acts in the manner of a spring and most conveniently, because the load can be controlled by the pressure, comprises a piston and cylinder assembly containing air or other resiliently compressible fluid. Thus, a single-acting continuously actuated air thruster may be used.

In the preferred embodiment, the drive means and the biasing means are operatively connected to abutments rigidly associated with the needle bar.

Whilst it is only necessary that the drive means should be operable to effect movement of the needle bar in the said one direction since the biasing means can be arranged to effect return of the bar in the opposite direction, if desired the drive means may be dual-acting and may be connected to the bar and/or linked to the biasing means so as to be capable of effecting movement of the bar in both directions. In this way, reliance need only be placed on the biasing means for purposes of taking up clearances, and also the machine can continue to operate, albeit without the benefits of the present invention, should the biasing means fail.

In order to enable operation of the mechanism to be monitored, limit switches may be appropriately positioned so as to be actuated by a moving part or parts of the mechanism.

BRIEF DESCRIPTION OF THE DRAWINGS

The particular features and advantages as well as other objects will become apparent from the following description taken in connection with the accompanying drawings, in which.

DESCRIPTION OF THE PREFERRED EMBODIMENT

Figure 1:
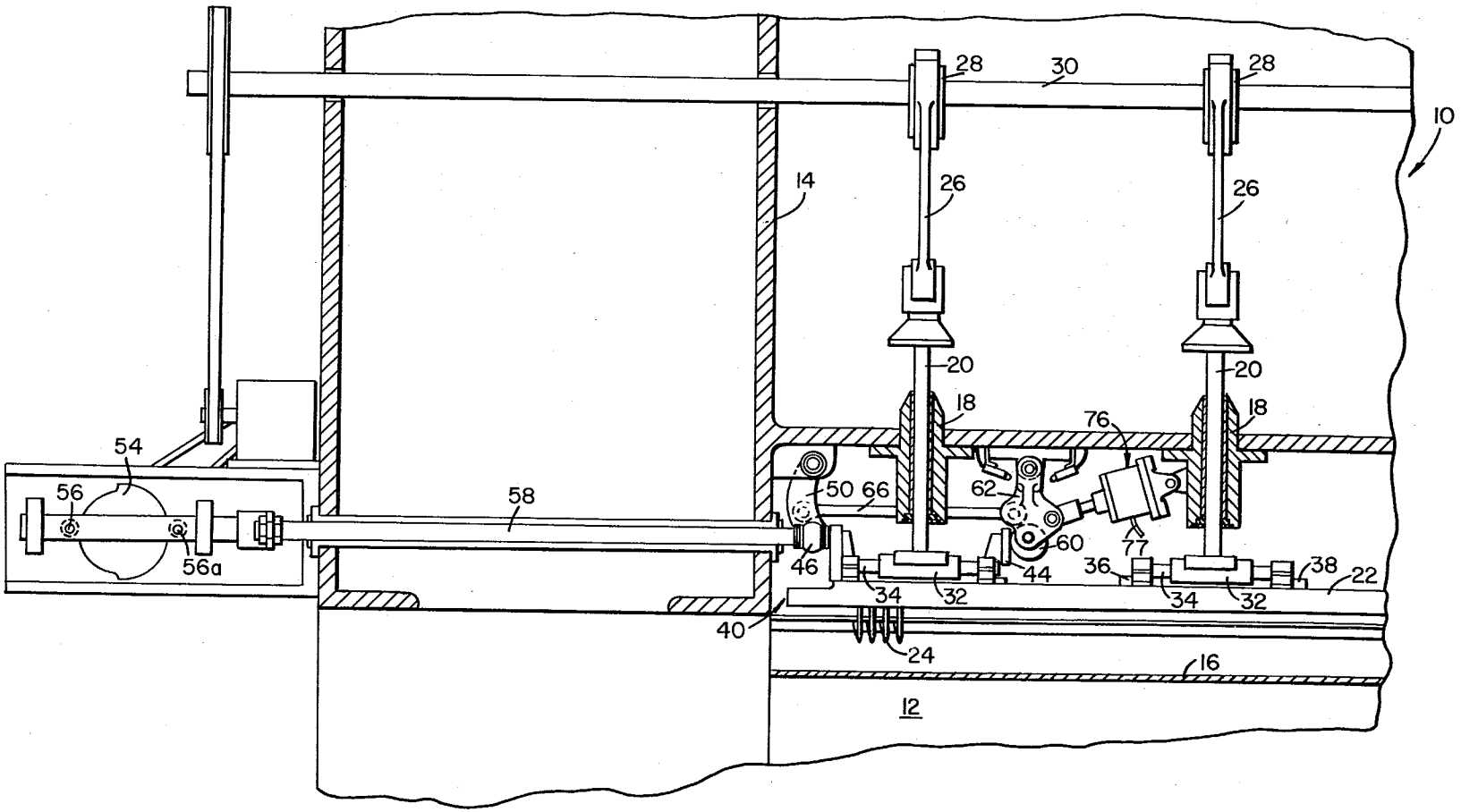
FIG. 1 is a fragmentary sectional view of a tufting machine incorporating a needle bar shifter including apparatus constructed in accordance with the principles of the present invention.
Figure 2:
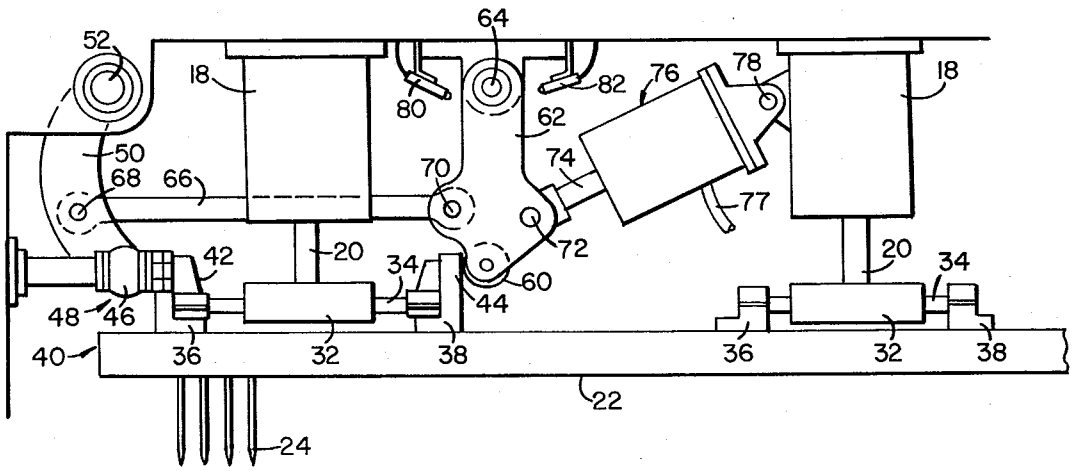
FIG. 2 is an enlarged diagrammatic side view of the needle bar portion of the machine illustrated in FIG. 1.

Referring now to the drawings there is illustrated the upper portion of a tufting machine 10 having a frame comprising a bed 12 and a head 14 disposed above the bed. The bed 12 includes a needle plate 16 over which a backing fabric (not illustrated) to be tufted is fed in a conventional manner.

Mounted in the head 14 for vertical reciprocation within bearing housings 18 are two of a plurality of spaced push rods 20 to the lower end of which a needle bar 22 is carried and which in turn carries a plurality of needles 24 adapted to penetrate the fabric on the needle plate 16 to project loops of yarn therethrough. Endwise reciprocation is imparted to the push rods 20 by a link 26 pivotably connected at its lower end to the push rods and at its upper end to an eccentric 28 on a driven rotary main shaft 30. Although not illustrated a plurality of loopers or hooks conventionally cooperate individually with the needles to seize the loops presented thereby and to hold the same to be cut or to release them as uncut loops.

As illustrated, each push rod 20 is connected to the bar 22 via a bearing assembly 32 slidable along a pair of parallel side-by-side guide rods 34 (only one of which can be seen in the drawing) fixed between supports 36,38 mounted on the bar, whereby the bar can move in both longitudinal directions thereof relative to the push rods 20. Other needle bar to push rods mountings can be utilized if desired, such as attaching the push rods to channel members within which the needle bar is slidably supported, as illustrated in U.S. Pat. No. 3,026,830 and others.

The supports 36, 38 for the guide rods 34 adjacent one end 40 of the bar 22 have upstanding abutments 42,44 thereto. One such abutment 42, which is adjacent to the bar end 40, is engaged on that side which faces towards the bar end 40, by a roller 46 at one end 48 of a curved arm 50, the other end of such arm 50 being pivotally mounted at 52 on the head 14 of the machine. The said one end 48 of the curved arm 50 may be linked to a conventional rotating pattern cam 54 by means of followers **56, 56*a* connected to a drive rod 58 so that such end 48 is constrained to follow the cam surface thereof. The arrangement is such that rotation of the cam subjects the arm 50 to a sequence of movements in both directions about its pivotal mounting 52, such sequence being determined by the shape of the cam surface. As the arm 50 swings from side to side the roller 46 is correspondingly urged against and away from the abutment 42 in the longitudinal direction of the bar 22**.

The abutment 44 opposite said abutment 42 is engaged, on that side which faces away from the bar end 40, by a roller 60 mounted at a lower position on a bracket 62 which is pivotally mounted at an upper position 64 thereon to the head 14 of the machine frame. The bracket 62 can swing from side to side about its pivotal mounting 64 so as to urge the roller 60 respectively against and away from the abutment 44 in the longitudinal direction of the bar 22.

A straight rigid connecting rod 66 may be pivotally connected at opposite ends 68, 70 respectively to the arm 50 and the bracket 62 at intermediate positions thereof, whereby both rollers 46,60 are held permanently in rolling engagement with the respective abutments 42,44.

The bracket 62 is also pivotally connected, at an intermediate position 72 on the side opposite to the link 66, to the piston 74 of a piston and cylinder assembly 76, the mounting end of the cylinder being pivotally mounted at 78 on the head 14 of the machine frame (via adjacent bearing housing 18 of the next adjacent push rod 20). The assembly 76 is a single acting continuously actuated pneumatic cylinder or air thruster which acts to apply a longitudinal force to the bar 22 via the bracket 62, the roller 60 and the abutment 44, air under pressure being applied to line 77 from conventional compressor apparatus (not illustrated) available in carpet mills.

In use, during rotation of the aforementioned cam 54, whenever the arm 50 is moved such as to cause the roller 46 to be urged against the abutment 42, the needle bar 22 is caused to be displaced longitudinally to the right (as shown in the drawing) against the action of the air thruster 76. Whenever the arm 50 is moved such as to cause the roller 46 to be urged away from the abutment 42, the bar 22 is displaced longitudinally to the left by pressure of the roller 60 on the abutment 44 due to the effect of the air thruster 76 and also due to the action of the arm 50 transmitted through the link 66.

The air thruster 76 applies a continuously acting force to the cam/cam follower mechanism whereby clearances therein are taken up and lost motion is eliminated or at least appreciably reduced. Precise movement of the bar 22 can therefore be achieved even with high speed fine gauge tufting machines. Consequently, the patterns tufted more accurately follow the pattern cut into the cam 54.

The presence of the link 66 ensures continued operation should the air thruster 76 fail. Movement of the bar 22 is monitored by limit switches 80, 82 which are mounted on the head 14 and arranged to be actuated by the bracket 62 at the normal limits of travel thereof.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a reciprocating needle bar carrying a plurality of needles spaced transversely across the machine adapted to penetrate a base material moving longitudinally thereof to insert a plurality of stitches upon each penetration of the base material, means for mounting said needle bar for transverse movement relative to said base material, and drive means for providing a controlled transverse displacement of the needle bar in at least one direction, the improvement comprising biasing means for urging said needle bar in a direction oppositely to said one direction in opposition to said drive means, said biasing means comprising an abutment on said needle bar, a bracket pivotably mounted in said tufting machine, a follower carried by said bracket and disposed for engagement with said abutment, and resilient means for acting on said bracket to maintain engagement of said follower with said abutment.

2. In a tufting machine as recited in claim 1, wherein said drive means includes a lever pivotably mounted in said tufting machine, pattern means drivingly connected to said lever to pivot said lever in at least a first direction, said first direction corresponding to said at least one direction, means connecting said lever to said needle bar to move said needle bar transversely in said one direction when said lever pivots in said first direction, whereby movement of said needle bar in said first direction pivots said bracket in a first direction, and said resilient means acting acting on said bracket in opposition to the needle bar.

3. In a tufting machine as recited in claim 2, wherein said resilient means comprises a piston and cylinder assembly, the piston being acted upon by a compressible fluid.

4. In a tufting machine as recited in claim 1, wherein said drive means provides a controlled transverse displacement of said needle bar in two opposed directions.

5. In a tufting machine as recited in claim 4, wherein said resilient means includes a piston and cylinder assembly, the piston being acted upon by a compressible fluid.

6. In a tufting machine as recited in claim 3, including means interconnecting said lever and said bracket for ensuring movement of said bracket in opposition to said lever.

* * * * *